US007162760B2

(12) United States Patent
Schweitzer

(10) Patent No.: US 7,162,760 B2
(45) Date of Patent: Jan. 16, 2007

(54) METHODS AND APPARATUS FOR A STEP MOUNTING SYSTEM

(76) Inventor: Kathleen M. Schweitzer, 1507 Shoemaker, St. Louis, MO (US) 63146

( * ) Notice: Subject to any disclaimer, the term of this patent is extended or adjusted under 35 U.S.C. 154(b) by 0 days.

(21) Appl. No.: 10/465,329

(22) Filed: Jun. 19, 2003

(65) Prior Publication Data

US 2004/0255406 A1 Dec. 23, 2004

(51) Int. Cl.
*E06C 7/16* (2006.01)
*E01D 1/00* (2006.01)

(52) U.S. Cl. ..... 14/69.5; 182/115

(58) Field of Classification Search ..... 14/69.5, 14/71.1, 72.5, 73, 78; 238/14; 182/115
See application file for complete search history.

(56) References Cited

U.S. PATENT DOCUMENTS

| | | | | | |
|---|---|---|---|---|---|
| 999,828 | A | * | 8/1911 | McNaughton | 410/94 |
| 1,082,807 | A | * | 12/1913 | Holworthy | 188/32 |
| 1,344,238 | A | * | 6/1920 | Lavallee | 238/14 |
| 1,389,400 | A | * | 8/1921 | Tufts | 238/14 |
| 1,574,729 | A | * | 2/1926 | Foster | 238/14 |
| 1,768,265 | A | * | 6/1930 | Nicholls | 188/32 |
| 2,043,820 | A | * | 6/1936 | Weller | 254/88 |
| 2,076,069 | A | * | 4/1937 | Davis | 254/88 |
| 2,232,903 | A | * | 2/1941 | Day | 254/88 |
| 2,449,829 | A | * | 9/1948 | Agren | 14/69.5 |
| 2,471,756 | A | * | 5/1949 | Larson | 254/88 |
| 2,491,718 | A | * | 12/1949 | Densmore | 254/88 |
| 2,607,937 | A | * | 8/1952 | Stone | 14/69.5 |
| 2,680,567 | A | * | 6/1954 | Steven | 238/14 |
| 2,723,005 | A | * | 11/1955 | Wink | 188/32 |
| 2,975,977 | A | * | 3/1961 | Chodacki et al. | 238/14 |
| 3,025,002 | A | * | 3/1962 | Kunz | 238/14 |
| 3,068,962 | A | * | 12/1962 | Petro | 188/32 |
| 3,387,686 | A | * | 6/1968 | Little | 188/32 |
| 3,606,253 | A | * | 9/1971 | Wooten | 254/88 |
| 3,630,487 | A | * | 12/1971 | Wechter, Jr. | 254/88 |
| 3,638,910 | A | * | 2/1972 | Nellis et al. | 254/88 |
| 3,647,029 | A | * | 3/1972 | Hanley | 188/32 |
| 3,701,474 | A | * | 10/1972 | Welz et al. | 238/14 |
| 3,910,491 | A | * | 10/1975 | Ducharme | 238/14 |
| 3,973,651 | A | * | 8/1976 | Garrett et al. | 188/32 |
| 4,013,268 | A | * | 3/1977 | Williams | 254/88 |
| 4,058,292 | A | * | 11/1977 | Goodrich et al. | 254/88 |
| 4,140,206 | A | * | 2/1979 | Yamazaki et al. | 188/32 |
| 4,300,722 | A | * | 11/1981 | Simmons | 238/14 |
| 4,327,896 | A | * | 5/1982 | Whitehead | 254/88 |
| 4,421,210 | A | * | 12/1983 | Sugino | 188/32 |
| 4,421,300 | A | * | 12/1983 | Lundman | 254/88 |
| 4,542,881 | A | * | 9/1985 | Naylor | 254/88 |
| 4,568,020 | A | * | 2/1986 | Gallichan | 238/14 |
| 4,630,709 | A | * | 12/1986 | Taylor | 182/48 |
| 4,726,516 | A | * | 2/1988 | Cree | 238/10 R |
| 4,895,347 | A | * | 1/1990 | Anderson | 254/88 |
| 5,100,054 | A | * | 3/1992 | Fickett et al. | 238/14 |
| 5,277,436 | A | * | 1/1994 | Frank et al. | 280/5.2 |
| 5,465,814 | A | * | 11/1995 | Ziaylek | 188/32 |
| 5,551,379 | A | | 9/1996 | Hart | |

(Continued)

*Primary Examiner*—Raymond Addie
(74) *Attorney, Agent, or Firm*—Armstrong Teasdale LLP

(57) ABSTRACT

A step mounting apparatus includes a stepping portion, at least one mounting support extending from the stepping portion, and at least one contact member attached to the at least one mounting support. The at least one contact member is adjustable with respect to the stepping portion such that an angle between the at least one contact member and the stepping portion can be varied.

20 Claims, 2 Drawing Sheets

U.S. PATENT DOCUMENTS 5,577,713 A 11/1996 Navarez
5,690,314 A * 11/1997 Williams ..... 254/88
5,782,819 A 7/1998 Tanzer
5,993,107 A 11/1999 Bauer
6,027,280 A 2/2000 Conners et al.
6,062,772 A 5/2000 Perkins
6,158,931 A * 12/2000 Savard ..... 410/40
6,379,100 B1 * 4/2002 Schultz ..... 414/499
6,394,362 B1 * 5/2002 Kramr ..... 238/14
6,484,343 B1 * 11/2002 Phillips ..... 14/69.5
6,520,420 B1 * 2/2003 Singh ..... 238/14
6,921,339 B1 * 7/2005 Martin et al. ..... 472/89
6,957,716 B1 * 10/2005 Norris ..... 182/48

* cited by examiner

METHODS AND APPARATUS FOR A STEP MOUNTING SYSTEM

BACKGROUND OF THE INVENTION

This invention relates generally to methods and apparatus for mounting platforms to uneven surfaces, and more particularly to methods and apparatus for a step mounting system.

The placement of level stepping surfaces on uneven ground has long been a challenge due to the changing grade of the terrain, as well as the type of soil or surface on which the stepping surface is being mounted. The grade, or slope of a piece of ground can vary dramatically in a short distance. Thus, stepping surfaces that are pre-manufactured to accommodate a specific grade are oftentimes unacceptable for the entire length of the area on which the stepping surface is being mounted.

BRIEF DESCRIPTION OF THE INVENTION

In one aspect of the invention, a step mounting apparatus is provided that includes a stepping portion, at least one mounting support extending from the stepping portion, and at least one contact member attached to the at least one mounting support. The at least one contact member is adjustable with respect to the stepping portion such that an angle between the at least one contact member and the stepping portion can be varied.

In another aspect, a method of mounting a stepping system to a ground surface is provided. The stepping system includes at least one mounting support, a stepping portion, and at least one contact member. The method comprising attaching the at least one mounting support to the stepping portion and attaching the at least one contact member to the at least one mounting support such that the at least one contact member is adjustable with respect to the stepping portion and an angle between the at least one contact member and the stepping portion can be varied.

DETAILED DESCRIPTION OF THE INVENTION

Exemplary embodiments of methods and apparatus for step mounting systems are described below. In one embodiment, the step mounting system includes a substantially planar member and a plurality of mounting portions extending from the planar member. The mounting portions are adjustable to accommodate different orientations of the planar surface.

Although exemplary embodiments are described herein, the methods and apparatus are not limited to those specific embodiments. For example, although methods and apparatus are described for a single step, in other embodiments, the system includes multi-step mounting systems. In addition, although the illustrated and described mounting system includes two mounting supports, it is to be understood that more or less than two mounting supports can be utilized. For example, a mounting system with one, three or four mounting supports can also be utilized.

The apparatus and methods are illustrated with reference to the figures wherein similar numbers indicate the same elements in all figures. Such figures are intended to be illustrative rather than limiting and are included herewith to facilitate explanation of an exemplary embodiment of the methods and apparatus of the invention.

Figure 1:
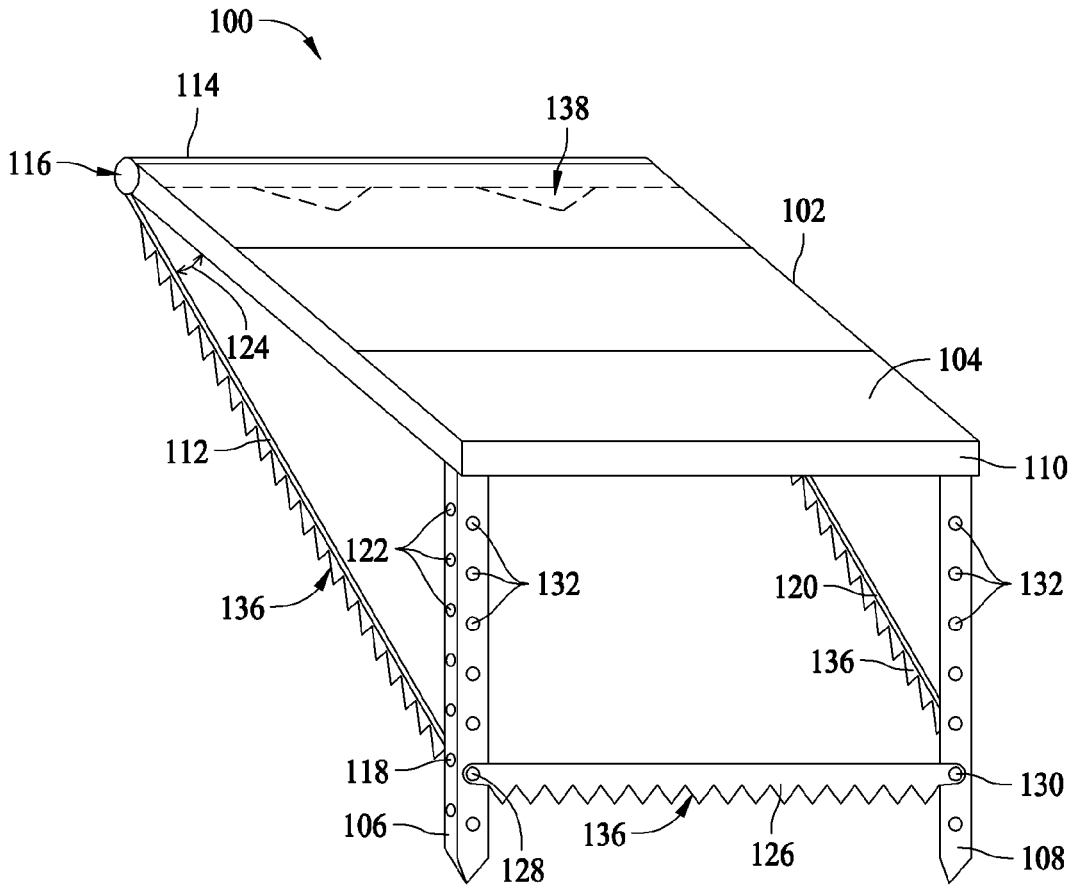
FIG. 1 illustrates a perspective view of a step mounting system in accordance with one embodiment of the present invention.

FIG. 1 illustrates a perspective view of a step mounting system 100 having a stepping portion 102 including a substantially planar stepping surface 104. System 100 also includes a pair of mounting supports 106, 108 extending from a first end 110 of stepping portion 102. In one embodiment, mounting supports 106, 108 are fixedly mounted to stepping portion 102. Alternatively, mounting supports are pivotally mounted to stepping portion 102.

A first contact member 112 extends between, and is attached to, first mounting support 106 and a second end 114 of stepping portion 102. In one embodiment, first contact member 112 is pivotally attached to second end 114 of stepping portion 102 with a first pin 116 and is connected to mounting support 106 with a second pin 118. A second contact member 120 extends between, and is attached to, second mounting support 108 and second end 114 of stepping portion 102. Although the term "pin" is used repeatedly throughout, it is to be understood that the term "pin" includes bolts, screws, plugs, nails, and other fasteners, whether or not they are threaded.

In one embodiment, mounting supports 106, 108 include a plurality of attachment connections 122, e.g., openings, through which an attachment pin such as second attachment pin 118, removably attaches mounting supports 106, 108 to contact members 112, 120, respectively. Attachment openings 122 extend along at least a portion of mounting support 106 and enable contact members 112, 120 to be attachable at multiple attachment locations along a length of mounting supports 106, 108, respectively, to vary the distance between a first end of contact members 112, 120 and stepping portion first end 110. Additionally, attachment of contact member 112 at different openings 122 provides for a height of stepping portion first end 110 to be altered with respect to the surface upon which mounting system 100 is being mounted. Further, attachment of contact member 112 at different openings 122 provides for a change in an angle 124 between contact member 112 and stepping portion 102. Accordingly, an angle between contact member 112 and stepping portion 102 can be varied.

In an alternative embodiment, mounting supports 106, 108 include a single attachment connection 122 and a single attachment connection 132. A height of stepping portion first end 110 is adjustable with respect to a surface upon which mounting system is being mounted by providing a variety of lengths of mounting supports 106, 108 and openings 122. The user then selects an appropriately sized mounting support 106, 108 for the surface upon which mounting system 100 is being mounted. This mounting support is attached to stepping portion 102 and a customizable step mounting system 100 is created that accommodates a variety of terrain grades.

Step mounting system 100 also includes a third contact member 126 extending between, and attached to, first mounting support 106 and second mounting support 108 with a third pin 128 and a fourth pin 130, respectively. Supports 106 and 108 include a plurality of attachment connections 132, e.g., openings, through which pins 128, 130 extend. Attachment connections 132 extend along at least a portion of mounting supports 106 and 108 and enable contact member 126 to be connected at one of multiple locations. Attachment of contact member 126 at different openings 132 provides for a height of stepping portion first end 110 to be altered with respect to the surface upon which mounting system 100 is being mounted. In one embodiment, third contact member 126 is substantially parallel with stepping portion first end 110. Alternatively, third contact member is angled with respect to stepping portion first end 110 to accommodate a difference in surfaces between first mounting support 106 and second mounting support 108.

In one embodiment, stepping portion 102 includes a lower portion 134 and mounting supports 106 and 108 are attached to lower portion 134. In addition, contact members 112, 120 are attached to lower portion 134 of stepping portion 102.

Contact members 112, 120, and 126 each include a plurality of engagement members 136 configured to engage a ground surface and maintain step mounting system 100 in a fixed position with respect to the surface upon which step mounting system 100 is mounted. In one embodiment, engagement members 136 are teeth extending from contact members 112, 120, and 126. Alternatively, engagement members 136 are fingers that project away from stepping portion 102. Second end 114 of stepping portion 102 also includes a plurality of engagement members 138 extending therefrom. Engagement members 138 extend substantially perpendicularly to stepping surface 104. Engagement members 138 maintain second end 114 of stepping portion 102 in a fixed orientation with respect to the surface upon which step mounting system 100 is being mounted.

Step mounting system 100 is utilized by attaching mounting supports 106, 108 to stepping portion 102 and attaching contact members 112, 120, and 126 to mounting supports 106, 108 such that contact members 112, 120, and 126 are adjustable with respect to stepping portion 102. Accordingly, an angle 124 between contact members 112, 120 and stepping portion 102 can be varied. Contact members 112 and 120 are also attached to second end 114 of stepping portion 102. Since mounting supports 106, 108 include a plurality of attachment locations 122, 132, a height of first end 110 of stepping portion 102 can be adjusted with respect to a surface upon which step mounting system 100 is to be mounted to provide a substantially level stepping surface. Once a correct location of contact members 112, 120 is attained, step mounting system 100 is ready to be positioned on a ground surface. Step mounting system 100 is then positioned by engaging engagement members 136, 138 with the surface of the ground on which step mounting system 100 is being mounted. Although stepping portion 102 has been described with respect to a single stepping surface, the above described step mounting system 100 is also able to accommodate multi-step stepping surfaces.

Figure 2:
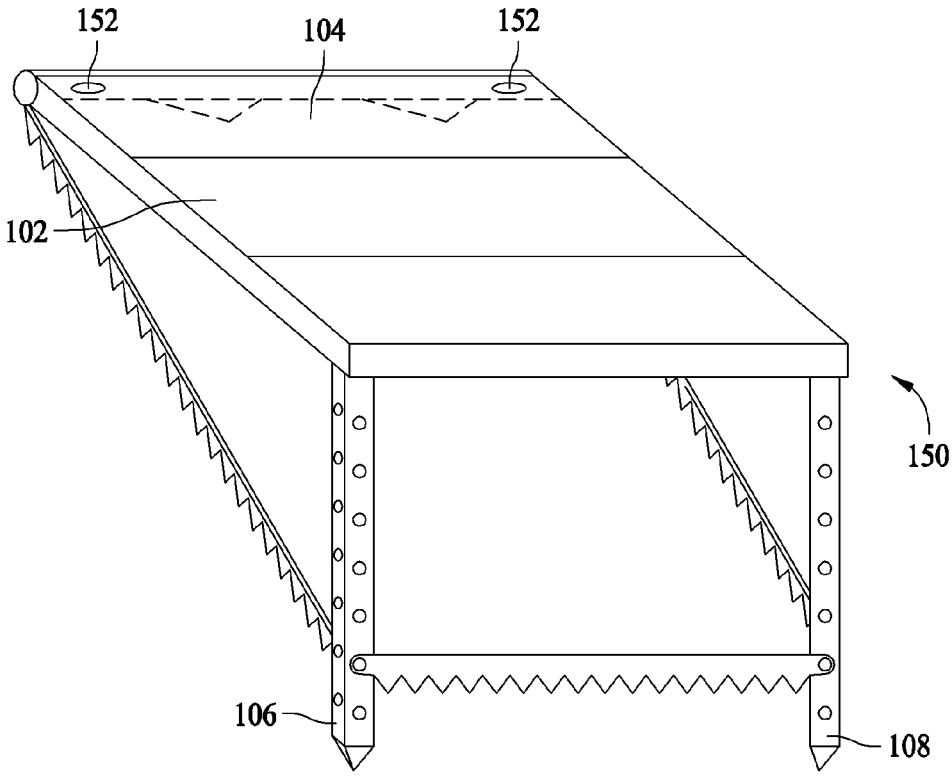
FIG. 2 is a step mounting system in accordance with FIG. 1 that includes a pair of openings to accommodate the creation of a multi-step stepping surface.

FIG. 2 illustrates an alternative step mounting system 150 that is substantially identical to step mounting system 100 shown in FIG. 1 except that system 150 includes a pair of openings 152 located near second end 114 of stepping portion 102. Reference numbers in FIG. 2 that are included in FIG. 1 refer to the same element in FIG. 2 referred to in FIG. 1. Openings 152 are sized and configured to receive mounting supports 106, 108 therein such that third contact portion 126 contacts stepping surface 104 near second end 114 of stepping portion 102. The accommodation by openings 152 of mounting supports 106, 108 provides for an easy assembly procedure for connecting a series of step mounting systems 152 in series. In this manner, step mounting system 150 can be used to create a single stepping path up and down a grade of land for which steps are desired. Step mounting system 150 is easy to assemble and can be customized to include the correct number of steps at the correct angle for the slope of the particular grade being traversed. In addition, each step can have a different height to accommodate the change in grade from step to step.

The above described apparatus and methods provide a step mounting system for placing stepping surfaces on rough terrain, e.g., not level, steep grade, and varying grades. Multiple steps can be linked together to create a consistent stepping surface along a length of terrain to be traversed. The steps can be customized to accommodate the actual grade of terrain being covered by the particular step.

While the invention has been described in terms of various specific embodiments, those skilled in the art will recognize that the invention can be practiced with modification within the spirit and scope of the claims.

What is claimed is:

1. Step mounting apparatus comprising:

a stepping portion comprising a first end, a second end, and a unitary body extending therebetween;

at least one mounting support extending substantially perpendicular from said stepping portion first end, wherein said at least one mounting support comprises a first mounting support and a second mounting support each having a pointed tip to configured extend below a ground surface and maintain a substantially fixed orientation therein, such that said stepping portion body extends between said first mounting support and said second mounting support; and at least one contact member extending from said at least one mounting support to said stepping portion second end, said at least one contact member adjustable with respect to at least one of said mounting support and said stepping portion second end such that an angle between said at least one contact member and said stepping portion second end can be varied, wherein said at least one contact member comprises a first contact member extending from said first mounting support to said stepping portion second end and a second contact member extending from said second mounting support to said stepping portion second end; and a plurality of engagement members extending from said at least one contact member, wherein each said engagement member is configured to extend below the ground surface and maintain a substantially fixed orientation therein.

2. Apparatus in accordance with claim 1 wherein said stepping portion comprises a substantially planar stepping surface.

3. Apparatus in accordance with claim 1 wherein said stepping portion comprises a lower portion, said at least one mounting support attached to said lower portion.

4. Apparatus in accordance with claim 3 wherein said at least one contact member is attached to said lower portion of said stepping portion.

5. Apparatus in accordance with claim 4 wherein said at least one contact member is pivotally attached to said lower portion of said stepping portion.

6. Apparatus in accordance with claim 1 wherein said at least one contact member further comprises a third contact member extending between said first and second mounting supports.

7. Apparatus in accordance with claim 1 wherein said at least one contact member includes a first end removably attached to said at least one mounting support.

8. Apparatus in accordance with claim 7 wherein said at least one contact member is attachable at multiple attachment locations along a length of said at least one mounting support to vary the distance between said at least one contact member first end and said stepping portion.

9. Apparatus in accordance with claim 1 wherein said at least one mounting support is pivotally mounted to said stepping portion.

10. Apparatus in accordance with claim 4 wherein said stepping portion second end comprises at least one engagement member extending therefrom.

11. Apparatus in accordance with claim 10 wherein a stepping surface at said stepping portion second end comprises at least one opening configured to accommodate said at least one mounting support from a second mounting apparatus to create a series of linked stepping surfaces.

12. Apparatus in accordance with claim 1 wherein said stepping portion comprises at least two substantially planar stepping surfaces.

13. Apparatus in accordance with claim 1 wherein said plurality of engagement members are serrated teeth.

14. Apparatus in accordance with claim 1 wherein said plurality of engagement members are lingers that project away from said stepping portion.

15. A method of mounting a stepping system to a ground surface, the stepping system including at least two mounting supports, a stepping portion, and at least one contact member, said method comprising:

attaching the at least two mounting supports to a lower surface of the stepping portion, wherein the stepping portion comprises a first end, a second end, and a unitary body extending therebetween such that the stepping portion body extends between the at least two mounting supports;

extending the at least two mounting supports substantially perpendicular from the stepping portion first end into the ground surface, wherein the mounting supports each have a pointed tip to pierce the ground surface and to maintain a substantially fixed orientation therein;

attaching the at least one contact member to the at least two mounting supports and the stepping portion such that the at least one contact member includes a plurality of engagement members and is adjustable with respect to at least one of the mounting supports and the stepping portion and an angle between the at least one contact member and the stepping portion can be varied;

piercing the ground surface with the plurality of engagement members to maintain a substantially fixed orientation therein; and providing a plurality of attachment locations on the at least two mounting supports for the at least one contact member to be attached thereto.

16. A method in accordance with claim 15 further comprising attaching the at least one contact member to the stepping portion.

17. A method in accordance with claim 15 further comprising adjusting a height of the first end of the stepping portion to provide a substantially level stepping surface.

18. A method in accordance with claim 17 wherein the stepping portion includes at least one opening at the second end, said method further comprising positioning the at least one mounting support within the at least one opening to create a series of linked stepping surfaces.

19. A method in accordance with claim 15 further comprising mounting the stepping system to a surface of the ground such that the stepping portion provides a substantially level stepping surface.

20. A method in accordance with claim 15 wherein the engagement members are serrated teeth, said method further comprising piercing the ground surface with the serrated teeth.

* * * * *